US008192248B2

(12) United States Patent
Albrecht et al.

(10) Patent No.: US 8,192,248 B2
(45) Date of Patent: Jun. 5, 2012

(54) SEMICONDUCTOR WAFER POLISHING APPARATUS AND METHOD OF POLISHING

(75) Inventors: Peter D. Albrecht, O'Fallon, MO (US); Guoqiang Zhang, Ballwin, MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 629 days.

(21) Appl. No.: 12/130,190

(22) Filed: May 30, 2008

(65) Prior Publication Data

US 2009/0298399 A1 Dec. 3, 2009

(51) Int. Cl.
*B24B 1/00* (2006.01)

(52) U.S. Cl. ..... 451/41; 451/55; 451/285; 451/287; 451/288; 451/398

(58) Field of Classification Search ..... 451/11, 451/41, 54, 55, 285, 287, 288, 289, 290, 451/397, 398

See application file for complete search history.

(56) References Cited

U.S. PATENT DOCUMENTS

| | | | | |
|---|---|---|---|---|
| 4,918,869 | A * | 4/1990 | Kitta | 451/288 |
| 5,036,630 | A * | 8/1991 | Kaanta et al. | 451/41 |
| 5,486,129 | A * | 1/1996 | Sandhu et al. | 451/5 |
| 5,605,488 | A * | 2/1997 | Ohashi et al. | 451/7 |
| 5,624,299 | A * | 4/1997 | Shendon | 451/28 |
| 5,664,987 | A | 9/1997 | Renteln | |
| 5,730,642 | A | 3/1998 | Sandhu et al. | |
| 5,816,900 | A * | 10/1998 | Nagahara et al. | 451/285 |
| 5,934,974 | A | 8/1999 | Tzeng | |
| 6,174,221 | B1 * | 1/2001 | Gotcher, Jr. | 451/41 |
| 6,176,764 | B1 * | 1/2001 | Gotcher | 451/41 |
| 6,277,000 | B1 * | 8/2001 | Gotcher | 451/41 |
| 6,383,059 | B1 * | 5/2002 | Gotcher | 451/41 |
| 6,531,397 | B1 | 3/2003 | Nagahara et al. | |
| 6,616,513 | B1 | 9/2003 | Osterheld | |
| 6,764,387 | B1 | 7/2004 | Chen | |
| 6,878,302 | B1 | 4/2005 | Corbellini et al. | |
| 7,137,874 | B1 | 11/2006 | Bovio et al. | |
| 7,140,956 | B1 | 11/2006 | Korovin et al. | |
| 7,207,871 | B1 | 4/2007 | Zuniga et al. | |

FOREIGN PATENT DOCUMENTS

| | | | |
|---|---|---|---|
| EP | 0653270 | A1 | 5/1995 |
| WO | 9636459 | A1 | 11/1996 |
| WO | 02066206 | A2 | 8/2002 |

OTHER PUBLICATIONS

F. Shimura, Semiconductor Silicon Crystal Technology 191, 195 (Academic Press 1989).

(Continued)

*Primary Examiner* — Eileen P. Morgan
(74) *Attorney, Agent, or Firm* — Armstrong Teasedale LLP

(57) ABSTRACT

A wafer polishing apparatus has a base and a turntable having a polishing pad thereon and mounted on the base for rotation of the turntable and polishing pad relative to the base about an axis perpendicular to the turntable and polishing pad. The polishing pad includes a work surface engageable with a front surface of a wafer for polishing the front surface of the wafer. A drive mechanism is mounted on the base for imparting rotational motion about an axis substantially parallel to the axis of the turntable. A polishing head is connected to the drive mechanism for driving rotation of the polishing head. The polishing head has a pressure plate adapted to hold the wafer for engaging the front surface of the wafer with the work surface of the polishing pad. The pressure plate has a generally planar position and is selectively movable from the planar position to a convex position and to a concave position.

17 Claims, 8 Drawing Sheets

OTHER PUBLICATIONS

PCT International Search Report and Written Opinion of the International Searching Authority mailed on Aug. 25, 2009 regarding PCT/US2009/044501; 12 pages.

European Communication regarding Application No. 09755636.9 dated Apr. 26, 2011, 5 pages.

* cited by examiner

SEMICONDUCTOR WAFER POLISHING APPARATUS AND METHOD OF POLISHING

BACKGROUND

This invention relates to apparatus and methods for polishing semiconductor wafers or similar type materials, and more specifically to such apparatus and methods which facilitate polishing of a semiconductor wafer to have a flat surface.

Polishing an article to produce a surface which is flat, highly reflective and damage free has application in many fields. A particularly good finish is required when polishing an article such as a wafer of semiconductor material in preparation for printing circuits on the wafer by an electron beam-lithographic or photolithographic process (hereinafter "lithography"). Flatness of the wafer surface on which circuits are to be printed is critical in order to maintain resolution of the lines, which can be as thin as 0.13 microns (5.1 microinches) or less. The need for a flat wafer surface, and in particular local flatness in discrete areas on the surface, is heightened when stepper lithographic processing is employed.

Flatness of the wafer surface can be quantified in terms of a global flatness variation parameter (for example, total thickness variation ("TTV")) or in terms of a local site flatness variation parameter (e.g., Site Total Indicated Reading ("STIR") or Site Focal Plane Deviation ("SFPD")) as measured against a reference plane of the wafer (e.g., Site Best Fit Reference Plane). STIR is the sum of the maximum positive and negative deviations of the surface in a small area of the wafer from a reference plane, referred to as the "focal" plane. SFQR is a specific type of STIR measurement, as measured from the front side best fit reference plane. A more detailed discussion of the characterization of wafer flatness can be found in F. Shimura, *Semiconductor Silicon Crystal Technology* 191, 195 (Academic Press 1989). Presently, flatness parameters of the polish surfaces of single side polished wafers are typically acceptable when a new polishing pad is being used, but the flatness parameters become unacceptable as the polishing pad wears, as described below.

The construction and operation of conventional polishing machines contribute to unacceptable flatness measurements. Polishing machines typically include a circular or annular polishing pad mounted on a turntable for driven rotation about a vertical axis passing through the center of the pad. The wafers are fixedly mounted on pressure plates above the polishing pad and lowered into polishing engagement with the rotating polishing pad. A polishing slurry, typically including chemical polishing agents and abrasive particles, is applied to the pad for greater polishing interaction between the polishing pad and the wafer. This type of polishing operation is typically referred to as chemical-mechanical polishing or simply CMP.

During operation, the pad is rotated and the wafer is brought into contact with the pad using the pressure plate. The pressure plate applies a generally uniform downward force across the wafer pressing the wafer against the pad. As the pad rotates, the wafer is rotated and oscillated back and forth about a portion of the pad that is off-center. As a result, pad wear is most significant in an annular band AB, which is illustrated in FIG. 1 by dark shading, that is contacted by the wafer during every revolution of the pad. The pad wear is gradationally less severe in the areas LA extending away from the annular band AB. These areas are only contacted by the wafer during some of the revolutions of the pad. Moreover, the portions of the pad farther from the annular band are contacted less frequently than portions of the pad closer to the annular band. As a result, these areas LA, which are represented in FIG. 1 by shading that becomes gradationally lighter away from the annular band, experience gradationally pad wear that is less severe away from the annular band and more severe closest to it. The outer most OM and inner most IM portions of the pad do not contact the wafer during the polishing operation and therefore do not experience any significant wear. These areas OM, IM are free from shading in FIG. 1.

When the pad wears, e.g., after a few hundred wafers, wafer flatness degrades because the pad is no longer flat but instead has an annular depression corresponding to the annular band AB of FIG. 1. Typically, such pad wear impacts wafer flatness in one of two ways: "dishing" and "doming". "Doming", which is more common than "dishing" and illustrated in FIG. 2, results in the wafer having a generally convex front surface (the front surface of the wafer is the surface polished by the pad). This results when the pad is worn as illustrated in FIG. 1 and, as a result, removes less material from the center of the front surface of the wafer than from the areas closer to the wafer's edge. This is because the pad's removal rate is inverse to its wear. In other words, the portions of the pad with less wear remove more material than portions of the pad with more wear. The least amount of material is removed from the wafer by the portion of the pad corresponding to the annular band AB. As a result, the front surface of the wafer is caused to have a generally "domed" shaped.

"Dishing" of the wafer surface occurs when the front surface of the wafer is caused to have a concave upper surface, which is illustrated in FIG. 3. One potential reason for this occurring is that the polishing pad becomes embedded with abrasives (i.e., colloidal material from the slurry, debris from previously polished wafers, debris from a retaining ring) thereby causing the removal rate to increase in the areas of wear. That is, the removal rate of the pad is directly proportional to its wear. Thus, the portions of the pad with more wear remove more material from the wafer during the polishing process than portions of the pad with less wear. As a result, more material is removed from the wafer from the portion of the pad corresponding to the annular band AB illustrated in FIG. 1 than from portions of the pad outward from the annular band. This discrepancy in removal rate causes more material to be removed from the center of the wafer than from its edge resulting in the front surface of the wafer having a generally "dished" shape.

When the flatness of the wafers becomes unacceptable (e.g., too "domed" or too "dished"), the worn polishing pad has to be replaced with a new one. Frequent pad replacement adds significant costs to the operation of the polishing apparatus not only because of the large number of pads that need to be purchased, stored, and disposed of but also because of the substantial amount of down time required to change the polishing pad.

Accordingly, there is a need for a polishing apparatus that inhibits both doming and dishing of the front surface of wafers during the polishing process and extends the useful life of the polishing pad.

SUMMARY

In one aspect, a wafer polishing apparatus generally comprises a base and a turntable having a polishing pad thereon and mounted on the base for rotation of the turntable and polishing pad relative to the base about an axis perpendicular to the turntable and polishing pad. The polishing pad includes a work surface engageable with a front surface of a wafer for polishing the front surface of the wafer. A drive mechanism is mounted on the base for imparting rotational motion about an axis substantially parallel to the axis of the turntable. A polishing head is connected to the drive mechanism for driving rotation of the polishing head. The polishing head has a pressure plate adapted to hold the wafer for engaging the front surface of the wafer with the work surface of the polishing pad. The pressure plate has a generally planar position and is selectively movable from the planar position to a convex position and to a concave position.

In another aspect, a polishing head for holding a wafer in a polishing apparatus generally comprises a pressure plate including a support plate for engaging and holding the wafer during operation of the polishing apparatus. The support plate has a generally planar position and is selectively moveable from the planar position to a convex position and to a concave position.

In yet another aspect, a method of polishing a semiconductor wafer generally comprises the steps of quantifying the flatness of a front surface of the semiconductor wafer. The semiconductor wafer is placed in contact with a polishing head of a wafer polishing apparatus. The polishing head has a pressure plate and the wafer is placed in direct contact with the pressure plate. The wafer is held by the polishing head so that a front surface of the wafer engages a work surface of the polishing pad. The front surface of the wafer is urged against the polishing pad. The pressure plate is deflected from a generally planar position to one of a convex position and a concave position based on the flatness of the front surface of the wafer. A polishing pad is rotated on a turntable of the polishing apparatus about a first axis and the polishing head is rotated generally about a second axis non-coincident with the first axis to thereby polish the front surface of the wafer. The wafer is disengaged from the turntable and removed from the polishing head.

In still another aspect, a method of polishing a batch of semiconductor wafer generally comprises the steps of placing one of the semiconductor wafers from the batch in contact with a polishing head of a wafer polishing apparatus. The polishing head has a pressure plate and the wafer is placed in direct contact with the pressure plate. The wafer is held by the polishing head so that a front surface of the wafer engages a work surface of the polishing pad. The work surface has wear. The pressure plate is deflected from a generally planar position to one of a convex position and a concave position based on the amount of wear in the work surface of the polishing pad. The front surface of the wafer is urged against the polishing pad. A polishing pad is rotated on a turntable of the polishing apparatus about a first axis and the polishing head is rotated generally about a second axis non-coincident with the first axis to thereby polish the front surface of the wafer. The wafer is disengaged from the turntable and removed from the polishing head.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION OF THE DRAWINGS

Figure 4:
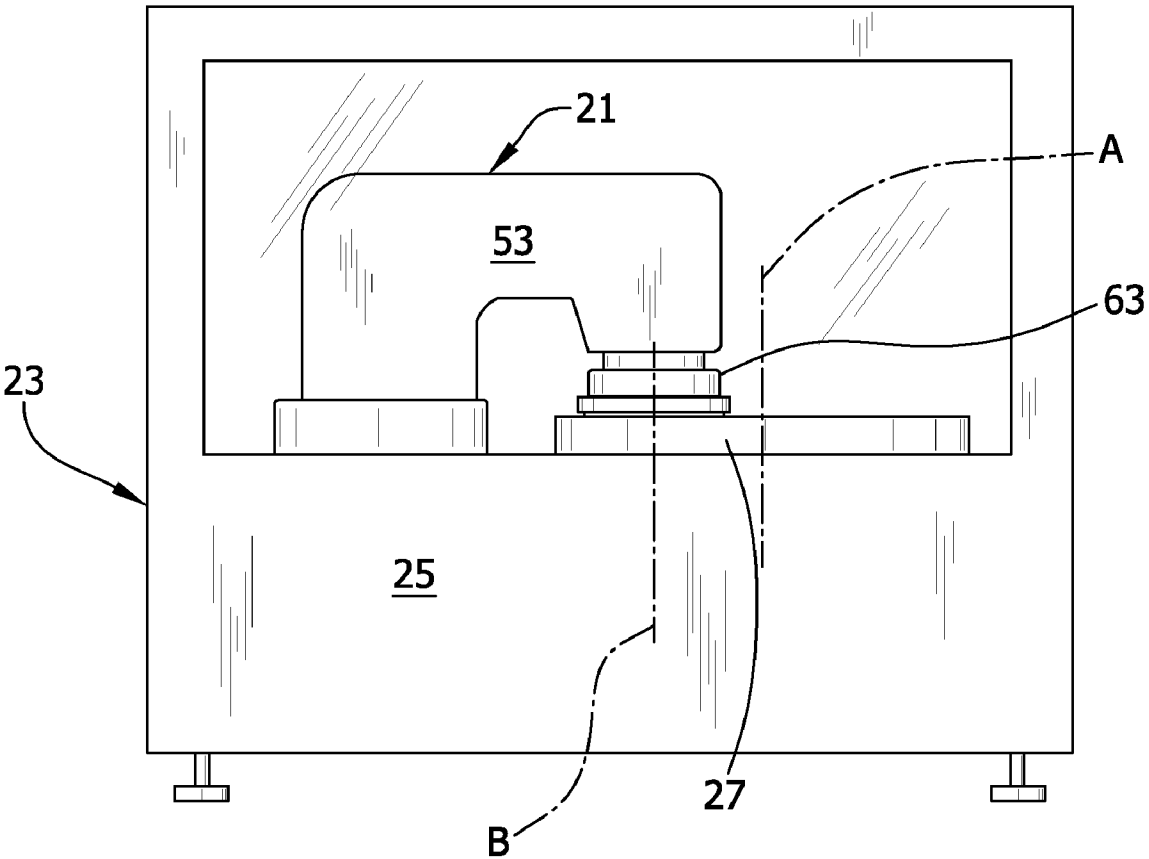
FIG. 4 is a side elevation of a wafer polishing apparatus inside a non-contamination booth.

Referring now to the figures, and specifically FIG. 4, a wafer polishing apparatus, generally indicated at 21, is shown having a base, generally indicated at 23. The base 23 may be of various configurations, but preferably is formed to provide a stable support for the polishing apparatus 21. In the illustrated embodiment, a booth 25 encloses the wafer polishing apparatus 21 and inhibits airborne contaminants from entering the booth and contaminating the apparatus and semiconductor wafer (or other article) being polished. Except as pointed out hereinafter, the construction of the polishing apparatus is conventional. An example of such a conventional single-sided polishing apparatus of the type discussed herein is the Strasbaugh Model 6DZ, available from Strasbaugh Inc. of San Luis Obispo, Calif.

Figure 5:
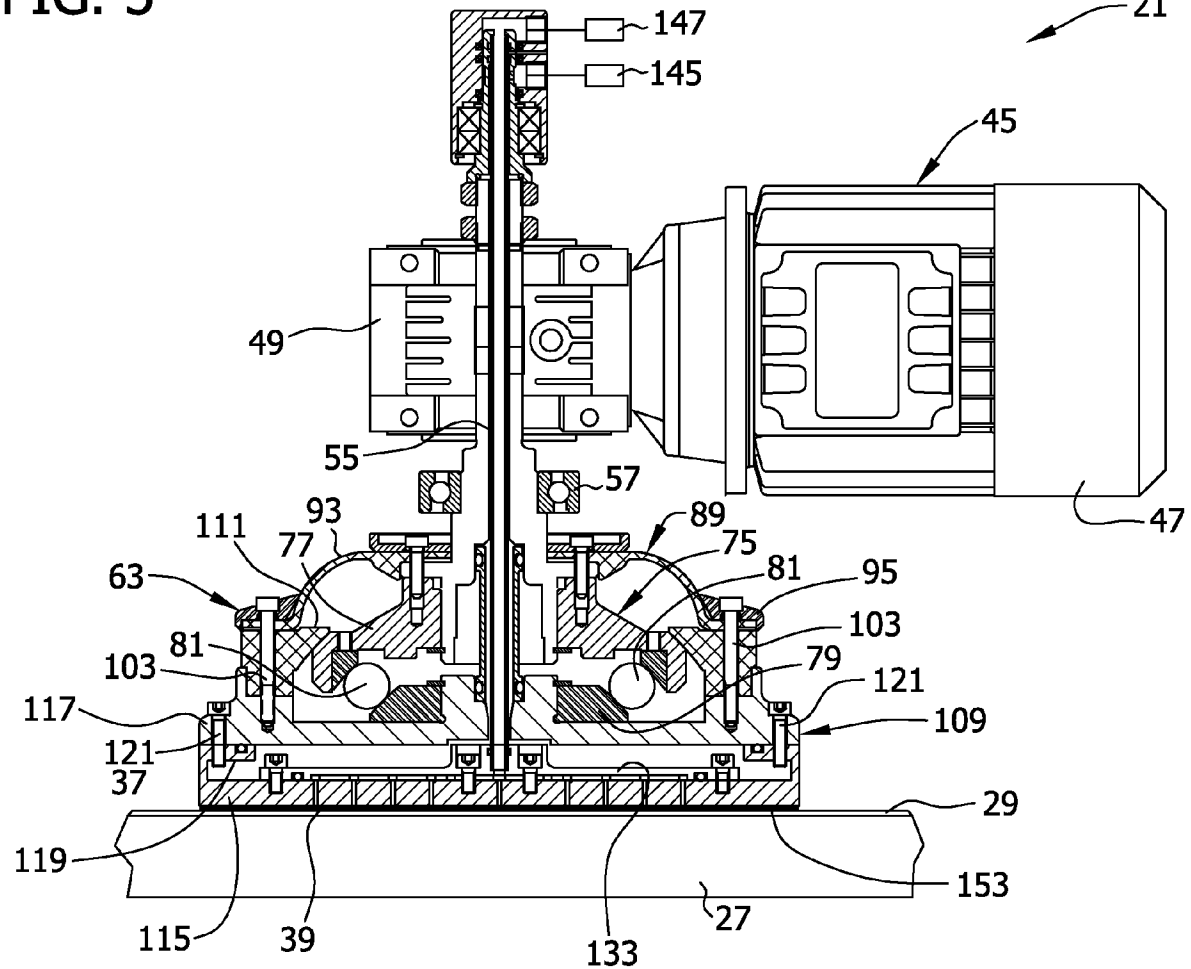
FIG. 5 is a side elevation and partial section of the wafer polishing apparatus of FIG. 4 omitted from the non-contamination booth for clarity.

With reference now to FIGS. 4 and 5, a turntable 27 is mounted on the base 23 for rotation with respect to the base. The turntable 27 is circular and has a polishing pad 29 mounted thereon for polishing a semiconductor wafer 35. The turntable and thereby the polishing pad 29 rotate conjointly relative to the base 23 about an axis A perpendicular to the turntable and polishing pad (FIG. 4). In one suitable configuration, the polishing pad 29 is adhesive-backed for securing the pad to the turntable 27. The opposite side of the polishing pad comprises a work surface 37 engageable with a front surface 39 of a semiconductor wafer 35. During polishing, the polishing pad 29 is designed to receive a continuous supply of polishing slurry. The polishing slurry is delivered to the pad 29 via a slurry delivery system (not shown). Suitable polishing pads, polishing slurry, and slurry delivery systems are well known in the relevant art.

The rotation of the turntable 27 is controlled by a turntable motor and turntable control device (not shown). The turntable control device controls the rotational speed of the turntable 27 to further adjust the polishing of the wafer 35, as will be discussed in greater detail below. Suitable turntable control devices and motors are well known in the relevant art.

A drive mechanism, generally indicated at 45 in FIG. 5, is mounted on the base 23 above the turntable 27 for imparting rotational motion of the drive mechanism about an axis B substantially parallel to axis A of the turntable (FIG. 4). The drive mechanism 45 comprises a motor 47 and a gearbox 49 housed in a movable arm 53. The movable arm 53, which is illustrated in FIG. 4, pivots both laterally and vertically, so that the arm can pick up, support, and release the semiconductor wafer 35 during the polishing process. The drive mechanism 45 also includes a control device (not shown) for controlling the rotational speed of the drive mechanism to enhance the polishing characteristics of the polishing process. The motor 47 is oriented horizontally within the arm 53 and connected to the gearbox 49, which comprises a suitable worm gear assembly (not shown), for converting the rotation of the motor about a horizontal axis into rotation of an output shaft 55 about axis B. The output shaft 55 passes from the gearbox 49 down through a radial bearing 57 for controlling shaft orientation.

Figure 6:
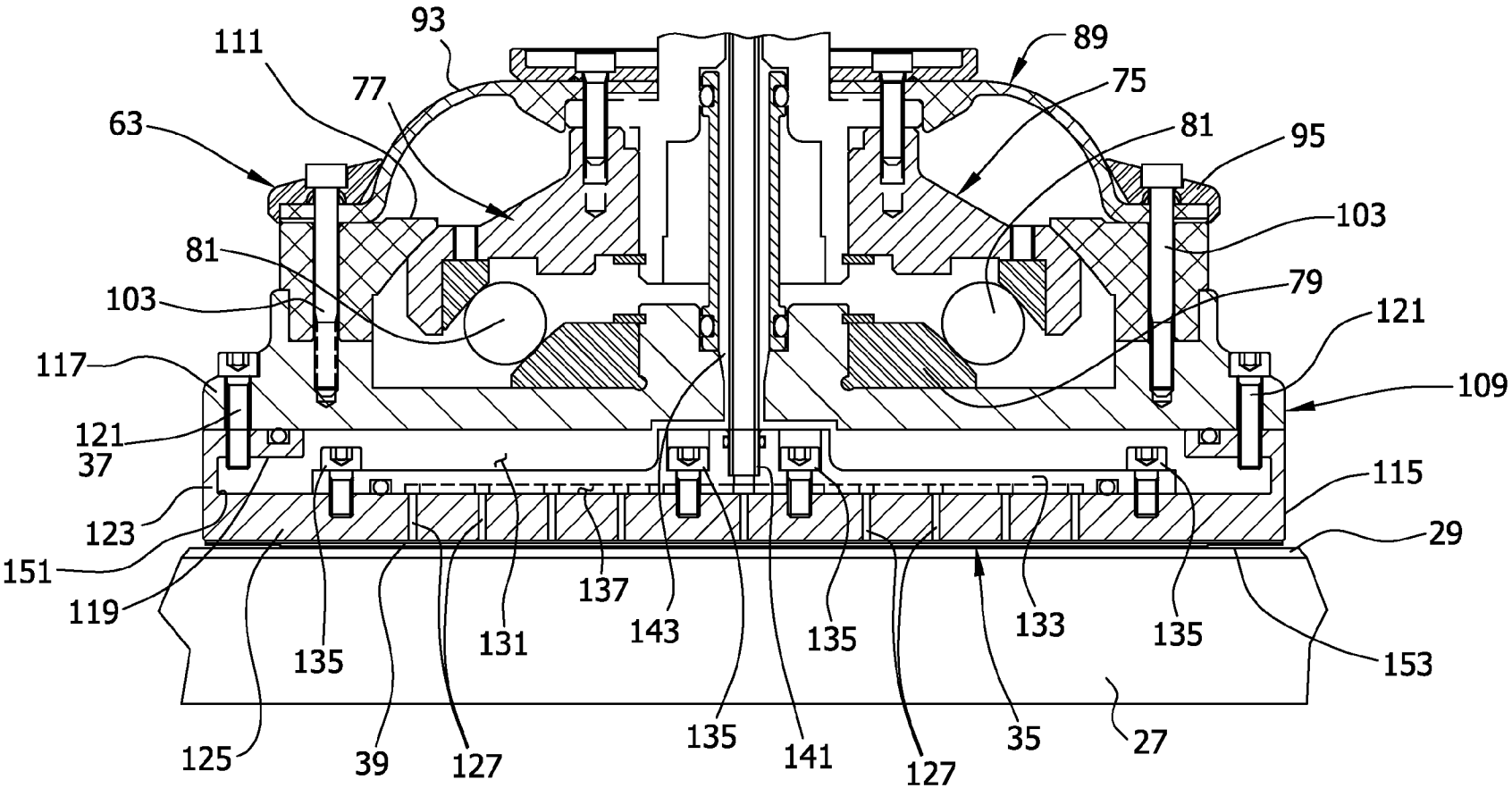
FIG. 6 is an enlarged, fragmentary schematic of the wafer polishing apparatus showing a polishing head thereof in section.

As illustrated in FIGS. 5 and 6, the wafer polishing apparatus 21 further comprises a polishing head, generally indicated at 63, pivotably and rotatably connected to the drive mechanism 45 for driven rotation of the polishing head. The polishing head 63 holds the wafer 35 securely during polishing so that the wafer may be polished evenly. The polishing head 63 mounts on the lower end of the output shaft 55 for conjoint rotation. Polishing heads 63 further comprises a spherical bearing assembly, generally indicated at 75. The assembly comprises an upper bearing member 77, a lower bearing member 79 and a plurality of ball bearings 81. The upper bearing member 77 and lower bearing member 79 are not rigidly connected to one another and may move with respect to one another. The ball bearings 81 are engageable with the upper bearing member 77 and the lower bearing member 79 for relative movement between the members, so that the polishing head 63 may pivot relative to the drive mechanism 45. The bearings 81 are preferably held within a conventional bearing race (not shown), as is well understood in the prior art, for holding the bearings in position between the bearing members 77, 79. The upper bearing member 77 is rigidly mounted on the drive mechanism 45 while the lower bearing member 79 is rigidly mounted to the polishing head 63. The upper bearing member 77 and the lower bearing member 79 have spherically shaped bearing surfaces arranged so that the center of curvature of each spherical bearing surface corresponds to a gimbal point as described in detail in U.S. Pat. No. 7,137,874, which is incorporated herein in its entirety. In the one embodiment, the bearing members 77, 79 and ball bearings 81 are formed from hardened steel or other material capable of withstanding repeated pivoting motions of the polishing head 63 as it rotates. The surfaces are highly polished to inhibit wear debris generation and to minimize friction within the spherical bearing assembly 75 and create a highly smooth pivoting movement of the bearing assembly.

With reference again to FIG. 1, the arm 53 applies downward pressure to the polishing head 63 during wafer polishing. As stated previously, the arm 53 pivots vertically about a horizontal axis near the proximal end of the arm (not shown). A hydraulic or pneumatic actuation system is commonly used to articulate the polisher arm 53, although other articulation systems are contemplated as within the scope of the present invention. These systems are well known in the relevant art and will not be described in detail here. Downward force from the actuation system is transferred to the wafer 35 through the output shaft 55, the upper bearing member 77, the ball bearings 81, and the lower bearing member 79.

The wafer polishing apparatus 21 further comprises a semi-rigid connection, generally indicated at 89, between the drive mechanism 45 and the polishing head 63 for imparting a rotational force from the drive mechanism to the polishing head (FIGS. 5 and 6). The semi-rigid connection 89 ensures that the polishing head 63 and drive mechanism 45 rotate conjointly so the control device can regulate the speed of the drive mechanism, and thereby the rotation of the wafer 35. Without the semi-rigid connection 89, the upper bearing member 77 would rotate with the drive mechanism 45 while the lower bearing member 79 and wafer 35 would fail to rotate beneath the spherical bearing assembly 75. The connection between the drive mechanism 45 and the polishing head 63 is preferably semi-rigid so that the universal pivoting motion of the polishing head with respect to the drive mechanism about the spherical bearing assembly 75 is unaffected by the driving force of the drive mechanism. The semi-rigid connection 89 is a flexible connection, which in the first embodiment is a torque transmittal boot 93 attached to the drive mechanism 45 and the polishing head 63. The boot 93 allows the polishing head 63 to pivot with respect to the drive mechanism 45 about horizontal axes passing through the gimbal point of the spherical bearing assembly 75 for transmitting the rotation from the drive mechanism to the polishing head.

A ring 95 fits over the outer edge of the torque transmittal boot 93 to secure the boot to the polishing head 63. The ring 95 and boot 93 each contain a plurality of matching holes so that a plurality of bolts 103 can pass through the ring and boot to firmly hold the boot to the polishing head 63. The ring 95 reinforces the boot 93 so that the rotational force transmitted through the boot spreads evenly over the circumference of the boot. In one embodiment, the torque transmittal boot 93 is made of an elastomeric material, such as rubber (e.g., urethane), having a stiffness capable of transmitting the rotational energy of the drive mechanism 45 to the polishing head 63 and a resiliency capable of allowing pivoting movement of the polishing head. Other materials capable of transmitting the rotation energy and allowing pivoting motion of the polishing head 63 are also contemplated as within the scope of the present invention.

As illustrated in FIG. 5, the polishing head 63 is further adapted to hold the wafer 35 for engaging the front surface 39 of the wafer with the work surface 37 of the polishing pad 29. The head 63 includes a lower body, generally indicated at 109, mounted on the lower bearing member 79. The lower body 109 rotates conjointly with the lower bearing member 79 and rigidly connects to the torque transmittal boot 93 as described above. Therefore, the boot 93 transfers the rotational energy of the output shaft 55 directly to the lower body 109 of the polishing head 63.

The lower body 109 additionally includes an inwardly directed annular flange 111 which projects inward above a portion of the upper bearing member 77 so that when the arm 53 lifts the polishing head 63 upward, the weight of the lower body 109, a pressure plate 115, and the wafer 35 rest upon the rigid upper bearing member, rather than the torque transmittal boot 93. This flange 111 helps preserve the torque transmittal boot 93 by not subjecting it to a repeated vertical tensile load when the arm 53 lifts the drive mechanism 45 and polishing head 63. The lower body 109 further comprises a retaining plate 117 for mounting the pressure plate 115 on the polishing head 63. More specifically, the pressure plate 115 includes a mounting flange 119 mounted beneath the retaining plate 117 for cooperating to create a seat for the pressure plate 115. A plurality of bolts 121 extend through the retaining plate 117 and mounting flange 119 to secure the pressure plate 115 to the polishing head 63.

As illustrated in FIG. 6, the pressure plate 115 of this embodiment includes a relatively thin annular wall 123 extending downward from the mounting flange 119. For example, the annular wall 123 has a thickness between about 2 millimeters (0.079 inches) and about 3 millimeters (0.118 inches) but it is understood that the annular wall can have different thicknesses without departing from the scope of this invention. A wafer support plate 125 is disposed below and is formed integrally with the annular wall 123 and mounting flange 119. The support plate 125 is sized and shaped for engaging and holding the wafer 35 during the polishing operation as described in more detail below. The wafer support plate 125 includes a plurality of passages 127 extending therethrough. It is contemplated that the mounting flange 119, the annular wall 123, and the support plate 125 can be formed from two or more separate pieces and connected together. It is also contemplated that the retaining plate 117 can be formed integrally with the mounting flange 119, the annular wall 123, and the support plate 125.

A first interior chamber 131 is disposed between and cooperatively defined by the pressure plate 115 and retaining plate 117. The first interior chamber 131 is fluidly connected to a first pressure source 145 via a conduit 143. The first pressure source 145 is operable to apply either a negative (i.e., a vacuum) or a positive pressure to the first interior chamber 131. In one suitable embodiment, the first pressure source 145 is capable of applying a vacuum of up to about 29 inches of mercury (in. Hg) and a positive pressure of up to about 40 pounds per square inch (psi). But it is understood that the first pressure source can apply different ranges of pressures than those provided without departing from the scope of this invention.

Figure 7:
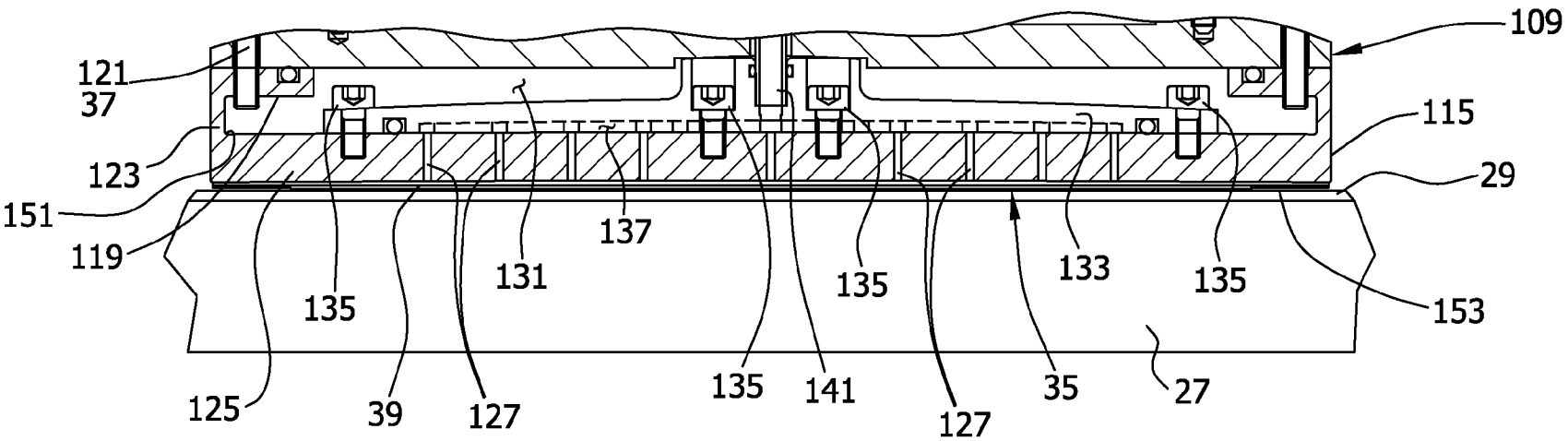
FIG. 7 is an enlarged, fragmentary schematic of the wafer polishing apparatus similar to FIG. 6 but showing a pressure plate of the polishing head in a concave position.

As illustrated in FIG. 7, applying a vacuum to the interior chamber 131 using the first pressure source 145 will cause the pressure plate 115 and more specifically the support plate 125 to deflect upward (i.e., away from the wafer 35) resulting in the support plate having a generally concave shape. Thus, the support plate 125 is moveable from a generally planar position (FIGS. 5 and 6) to a generally concave position (FIG. 7). The amount of upward deflection in the support plate 125 is directly proportional to the amount of vacuum applied to the interior chamber 131 by the first pressure source 145. That is, the greater the applied vacuum, the greater the upward deflection. Moreover, the amount of deflection in the support plate 125 is greatest at its center and decreases radially outward toward the edge of the pressure plate.

Figure 8:
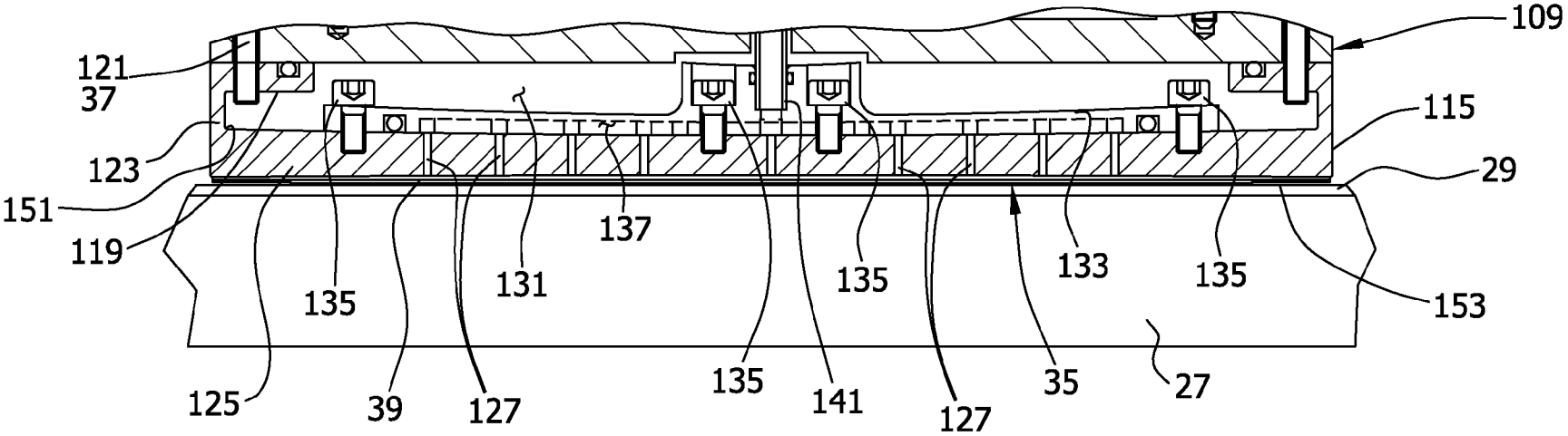
FIG. 8 is a schematic similar to FIG. 7 but showing the pressure plate in a convex position.

With reference now to FIG. 8, applying a positive pressure to the interior chamber 131 using the first pressure source 145 will cause the support plate 125 to deflect downward toward the wafer 35 resulting in the pressure plate having a generally convex shaped. The amount of downward deflection in the support plate 125 is directly proportional to the amount of positive pressure applied to the interior chamber 131. That is, the greater the positive pressure, the greater the downward deflection. Thus, the pressure plate 115 and more specifically the support plate 125 can be moved to a convex position, which is illustrated in FIG. 8.

In both the concave position and convex position of the pressure plate 115, the amount of deflection in the support plate 125 is greatest at its center and decreases generally radially outward toward the edge of the support plate. As a result, the support plate 125 is capable of deflecting in a generally smooth curve. In one embodiment, the amount of deflection in the support plate 125 at its center is less than about 100 micrometers, and more suitably less than about 50 micrometers. For example, the support plate 125 is capable of deflecting at its center between about 0 micrometers and about 50 micrometers. It is understood, the support plate 125 can have ranges of deflection at its center without departing from the scope of this invention.

In the illustrated embodiment, the relatively thin annular wall 123 acts as a hinge about which the support plate 125 deflects. In other words, the relatively thin annular wall 123 flexes in relation to the deflection of the support plate 125. When the support plate 125 deflects upward (i.e., the concave position of the pressure plate 115), the annular wall 123 flexes outward away from output shaft 55 of the drive mechanism 45, and when the support plate deflects downward (i.e., the convex position of the pressure plate), the annular wall flexes inward toward the output shaft of the drive mechanism. In another embodiment, the support plate 125 is capable of pivoting upward and downward relative to the annular wall 123 about a corner 151 between the support plate and annular wall. In other words, the corner 151 can act as a hinge. The relative movement of the annular wall 123 and support plate 125 is a function of the type of material used and the thickness of the material.

The thickness of the annular wall 123 is one variable that directly influences the amount of deflection the support plate 125 is capable of achieving. (Other variables that influence the deflection of the support plate 125, for example, include the material that the pressure plate 115 is made from, the thickness of the pressure plate 115, and the height of the annular wall 123). The thinner the annular wall 123 is formed, the more readily and more uniformly the support plate 125 will deflect. However, the annular wall 123 needs to be sufficiently robust to withstand the polishing operation. In one suitable embodiment, as mentioned above, the thickness of the annular wall can be between about 2 millimeters (0.079 inches) and about 3 millimeters (0.118 inches). It is understood, however, that the annular wall can have different thicknesses without departing from the scope of this invention. In one suitable embodiment, the pressure plate 115 is made from stainless steel, 10 millimeters thick, but it is understood that the pressure plate can be made from other types of material. For example, the pressure plate 115 can be made from polyetheretherketone (PEEK) or other suitable plastics.

With reference to FIGS. 5 and 6, a baffle plate 133 is mounted (e.g., by bolts 135) to the support plate 125 in the first interior chamber 131. The baffle plate 133 and support plate 125 cooperatively define a second interior chamber 137. The second interior chamber 137 is in fluid communication with both a second pressure source 147 and the passages 127 formed in the support plate 125. The second pressure source 147 is connected to the second interior chamber 137 via a conduit 141. The second pressure source 147 is capable of applying a positive pressure or a vacuum directly to a back surface 155 of the wafer 35 through the passages 127 in the support plate 125. In use, a vacuum can be applied by the second pressure source 147 to hold the wafer 35 against the support plate 125 to thereby lift the wafer for placing the wafer onto the polishing pad 29 and for removing the wafer from the pad. A positive pressure can be applied by the second pressure source 147 during the polishing operation to negate the presence of the passages 127 in the support plate 125. In the illustrated embodiment, the conduits 141, 143 are coaxially aligned with the shaft 55 but it is understood that the conduits can be directed to the first interior chamber 131 and the second interior chamber 137 along different pathways.

Referring again to FIG. 6, a retaining ring 153 is mounted on the bottom of the support plate 125 by a plurality of annularly spaced bolts (not shown). The retaining ring 153 retains the wafer 35 during polishing by forming a barrier prohibiting the wafer from moving laterally out from under the polishing head 63. The retaining ring 153 is in radially opposed relation with the edge of the wafer 35 during the polishing operation. It is understood that the retaining ring 153 can be mounted on the support plate 125 in other suitable manners (e.g., adhering).

In use, one or more semiconductor wafers 35 are delivered to the wafer polishing apparatus 21 for polishing. The wafers 35 are preferably formed from monocrystalline silicon, although the polishing apparatus and method of polishing described herein are readily adaptable to polishing other materials. The semiconductor wafers 35 can be delivered to the wafer polishing apparatus using any suitable manner. In one arrangement, a plurality of wafers 35 are delivered to the polishing apparatus 21 in a cassette (not shown), which are conveniently used, for storage and transfer of a plurality of wafers. These cassettes can be of various sizes for holding any number of wafers, such as 25, 20, 15, 13, or 10 wafers per cassette.

In one embodiment, a single wafer 35 is removed from the cassette and the surface flatness of the front surface 39 of the wafer 35 is quantified using any conventional method. As mentioned previously, flatness of the front surface 39 of the wafer 35 can be quantified in terms of a global flatness variation parameter (for example, total thickness variation ("TTV")) or in terms of a local site flatness variation parameter (e.g., Site Total Indicated Reading ("STIR") or Site Focal Plane Deviation ("SFPD")) as measured against a reference plane of the wafer (e.g., Site Best Fit Reference Plane). In another embodiment, the flatness of the wafer 39 is not quantified before the polishing operation. Instead, the flatness is determined only after the wafer 39 has been polished.

After the surface flatness of the front surface 39 of the wafer is quantified, the wafer 35 is moved to a location suitable for being received in the polishing head 63 of the polishing apparatus 21. More specifically, the back surface 155 of the wafer 35 is contacted by the support plate 125 of the pressure plate 115. A vacuum generated by the second pressure source 147 is applied to the back surface 155 of the wafer 35 via the passages 127 in the support plate to hold the wafer in contact with the polishing head 63. The retaining ring 153 mounted on the support plate 125 inhibits lateral movement of the wafer 35 with respect to the support plate. Using the arm 53, the wafer 35 is lifted, moved, and placed into contact with the polishing pad 29 so that the front surface 39 of the wafer is in direct contact with the working surface 37 of the polishing pad. A downward force is applied by the arm 53 of the polishing apparatus 21 to urge the wafer 35 against the polishing pad 29.

The turntable 27 mounted on the base 23 and thereby the polishing pad 29 is rotated conjointly relative to the base 23 about the axis A. With the polishing pad 29 rotating, a continuous supply of polishing slurry is delivered to the pad via a slurry delivery system (not shown). The rotation of the turntable 27 is controllable by a turntable motor and turntable control device (not shown) to selectively set the rotational speed of the polishing pad 29. The slurry delivery is controllable using the slurry delivery system.

The polishing head 63 is rotated using the drive mechanism 45 about an axis B, which is substantially parallel to and spaced from axis A of the turntable (FIG. 4). The rotation speed of the polishing head 63 is controlled using the control device (not shown) of the drive mechanism 45. In one suitable embodiment, the turntable 27 and the polishing head 63 are rotated in opposite directions and at different speeds. In addition to being rotated, the polishing head 63 is oscillated by the arm 53 relative to the polishing pad 29. Since the wafer 35 is securely held to the polishing head 63, the wafer rotates and oscillates with the polishing head while the arm urges the front surface 39 of the wafer 35 into contact with the polishing pad 29.

With the wafer 35 urged into contact with the polishing pad 29, the second pressure source 147 is operated to apply a positive pressure to negate the presence of the passages 127 in the support plate 125. The positive pressure and vacuum applied by the second pressure source 147 are transferred directly to the back surface 155 of the wafer 35. The second pressure source 147 selectively pressurizes or applies a vacuum to the second interior chamber 137, which is defined by the baffle plate 133 and support plate 125, via conduit 141. The pressure/vacuum is applied directly to the back surface 155 of the wafer 35 through the passages 127 in the support plate 125.

Based on the flatness of the front surface 39 of the wafer 35, the proper or optimum position of the support plate 125 of the pressure plate 115 is determined. As mentioned above, the support plate 125 can be in a generally planar position (FIG. 6), a concave position (FIG. 7), or a convex position (FIG. 8). If the front surface 39 of the wafer 35 is generally flat then the support plate 125 will remain in its generally planar or neutral position during the polishing operation. If the front surface 39 of the wafer 35 has a "domed" shape then the support plate 125 will be moved to its convex position so that a greater pressure is applied to the center of the wafer than at its edge. If the front surface 39 of the wafer has a "dished" shape then the support plate 125 will be moved to its concave position so that a greater pressure is applied to the edge of the wafer than its center.

The support plate 125 of the pressure plate 115 is moved from its generally planar position to its convex position by pressurizing the first interior chamber 131, which is defined by the pressure plate 115 and retaining plate 117. Applying a positive pressure to the interior chamber 131 causes the support plate 125 to deflect downward toward the wafer 35 resulting in the support plate having a generally convex shaped. The amount of downward deflection in the support plate 125 is directly proportional to the amount of positive pressure applied to the interior chamber 131. That is, the greater the positive pressure, the greater the downward deflection. The amount the support plate 125 is deflected is based on the degree of doming of the front surface 39 of the wafer 35. The support plate 125 will be deflected a greater amount for a wafer having more doming than for a wafer having less.

The convex position of the support plate 125 results in the center of the front surface 39 of the wafer 35 being urged into contact with the polishing pad 29 under a greater pressure than the edge of the wafer. As a result, more wafer 35 material is removed from the center of the wafer than from its edges. In other words, the center of the wafer 35 is polished more than its edges. This discrepancy in material removal from the front surface 39 of the wafer 35 results in a wafer having a domed front surface being polished into a wafer having a generally flat front surface.

The support plate 125 of the pressure plate 115 is moved from its generally planar position to its concave position by applying a vacuum to the first interior chamber 131. Applying a vacuum to the interior chamber 131 causes the support plate 125 to deflect upward away from the wafer 35 resulting in the support plate having a generally concave shape. The amount of upward deflection in the support plate 125 is directly proportional to the amount of vacuum applied to the interior chamber 131. That is, the greater the vacuum, the greater the upward deflection. The amount the support plate 125 is deflected is based on the degree of dishing of the front surface 39 of the wafer 35. The support plate 125 will be deflected a greater amount for a wafer having more dishing than for a wafer having less.

The concave position of the support plate 125 results in the edge of the front surface 39 of the wafer 35 being urged into contact with the polishing pad 29 under a greater pressure than the center of the wafer. As a result, more wafer 35 material is removed from adjacent the edge of the wafer than from its center. In other words, the edge of the wafer 35 is polished more than its center. This discrepancy in material removal from the front surface 39 of the wafer 35 results in a wafer having a generally dish shaped front surface being polished into a wafer having a generally flat front surface.

In both the concave position and convex position of the pressure plate 115, the amount of deflection in the support plate 125 is greatest at its center and decreases radially outward toward the edge of the support plate. As mentioned above, the support plate 125 is hingely connected to the annular wall 123. As a result, the support plate 125 is capable of pivoting with respect to the annular wall 123.

Figure 1:
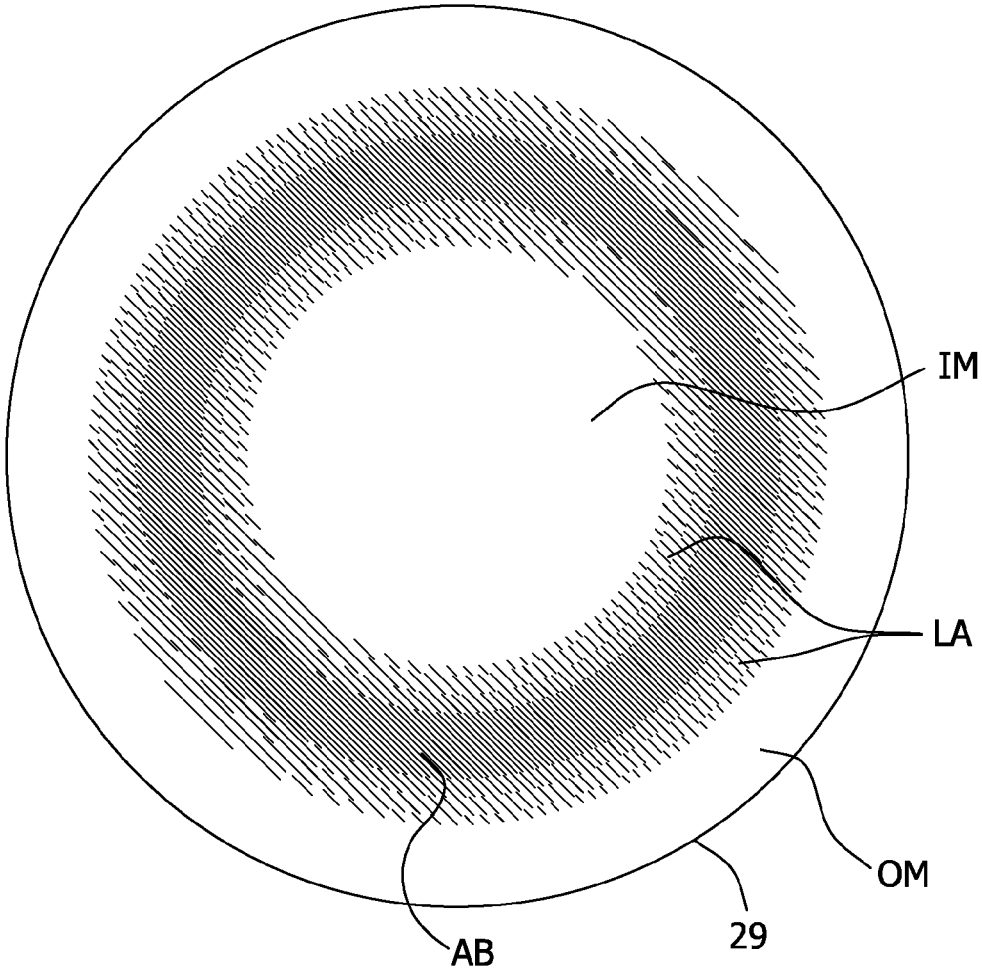
FIG. 1 is a top plan of a conventional polishing pad illustrating areas of pad wear.
Figure 2:
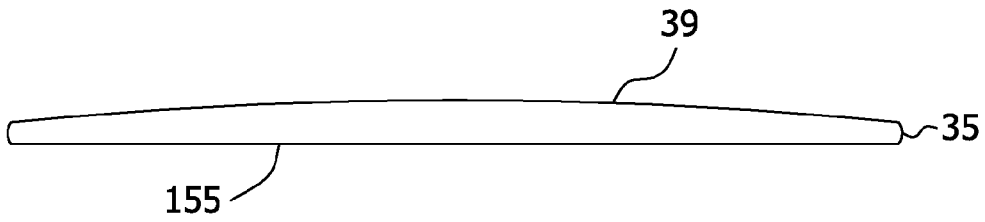
FIG. 2 is a side elevation of a domed-shaped wafer.
Figure 3:
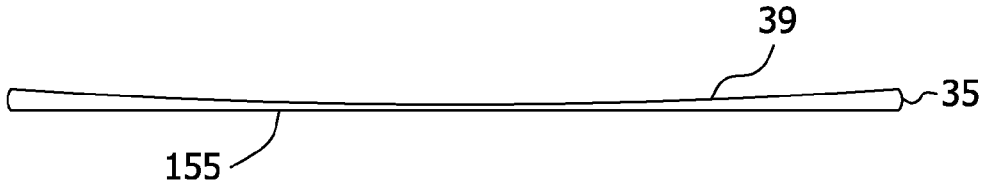
FIG. 3 is a side elevation of a dished-shaped wafer.

In another embodiment, the position and amount of deflection (if any) of the support plate 125 is determined based on the wear of the polishing pad 29. As mentioned above and illustrated in FIG. 1, pad wear results in an annular band AB of pad being worn more than other portions of the pad because the wafer 35 contacts the portion of the pad within the annual pad every revolution of the pad. The pad wear is gradationally less severe in areas LA extending away from the annular band AB because these areas are only contacted by the wafer during some revolutions of the pad. Moreover, the portions of the pad farther from the annular band are contacted less frequently than portions of the pad closer to the annular band. As a result, these areas LA, which are represented in FIG. 1 by shading that becomes gradationally lighter away from the annular band, experience gradationally pad wear that is less severe away from the annular band and more severe closest to it. The outer most and inner most portions OM, IM of the pad do not contact the wafer during the polishing operation and therefore do not experience any significant wear. These areas are free from shading in FIG. 1.

When the pad wears, the pad is no longer flat but instead has an annular depression corresponding to the annular band AB of FIG. 1. In one embodiment to compensate for the pad wear resulting in a decrease in material being removed from the center of the front surface 39 of the wafer 35, the support plate 125 is moved from its generally planar position to its convex position so that a greater pressure is applied to the center of the wafer than at its edge. The support plate 125 of the pressure plate 115 is moved from its generally planar position to its convex position by pressurizing the first interior chamber 131, which causes the support plate 125 to deflect downward toward the wafer 35 as mentioned above. The support plate 125 will be deflected a greater amount for a polishing pad 29 having more wear than for a polishing pad having less.

In one embodiment, to compensate for pad wear resulting in an increase in material being removed from the center of the front surface 39 of the wafer 35, the support plate 125 is moved from its generally planar position to its concave position by applying a vacuum to the first interior chamber 131. This causes the support plate to deflect upward away from the wafer 35 as described above. The concave position of the support plate 125 results in the edge of the front surface 39 of the wafer 35 being urged into contact with the polishing pad 29 under a greater pressure than the center of the wafer.

The front surface 39 of the wafer 35 is actively polished by the polishing apparatus 21 for a selected period of time. During the polishing operation, the front surface 39 of the wafer 35 is polished to a finish polish, while the back surface 155 of the wafer is not polished to a finish polish. When the polishing operation is complete, the wafer is removed from the polishing head 63 and the polishing apparatus 21. Removal of the wafer 35 is facilitated by applying air pressure to chamber 137, with the air blowing out the holes 127, causing the wafer to release from the polishing head 63.

After the wafer 35 is removed from the polishing apparatus 21, the surface flatness of the front surface 39 of the wafer 35 is quantified using any conventional method. As mentioned previously, flatness of the wafer 35 can be quantified in terms of a global flatness variation parameter (for example, total thickness variation ("TTV")) or in terms of a local site flatness variation parameter (e.g., Site Total Indicated Reading ("STIR") or Site Focal Plane Deviation ("SFPD")) as measured against a reference plane of the wafer (e.g., Site Best Fit Reference Plane). Based on the surface flatness of the wafer 35, the position of the support plate 125 (i.e., planar, convex, and concave) can be altered for polishing subsequent wafers. Thus, adjustments in the support plate 125 can be made over time as the polishing pad 29 wears to compensate for the changes in the polishing characterization of the pad. That way the flatness of subsequently polished wafers is not adversely affected by pad wear. It is understood that if the wafer's surface flatness is unacceptable, the wafer 35 can be re-polished.

Accordingly, the polishing head 63 and, more specifically, the pressure plate 115 disclosed herein compensates for wear of the polishing pad 29 thereby improving the TTV of the wafers being polished with a worn polished pad and extending the useful life of the polishing pad. This reduces the number of polishing pads 29 that need to be purchased and reduces the number of times the pad needs to be changed.

Figure 9:
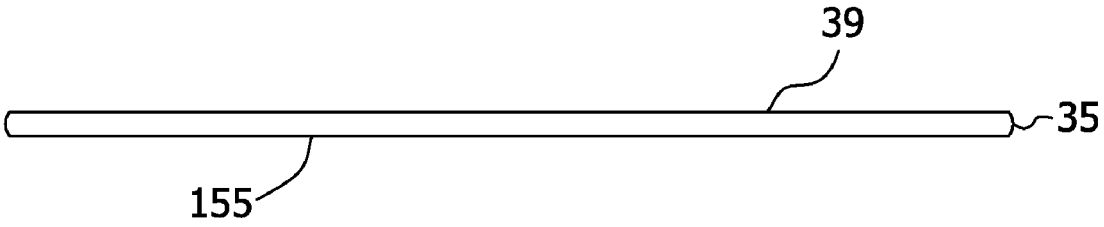
FIG. 9 is a side elevation of a polished wafer of uniform thickness and flatness.

With reference now to FIG. 9, the present invention is additionally directed to one or more single side polished, monocrystalline semiconductor wafers 35 polished on the wafer polishing apparatus 21 described above. The wafers 35 are preferably formed from monocrystalline silicon, although the polishing apparatus and method of the present invention are readily adaptable to polishing other materials. The front surface 39 of a wafer 35 is polished to a finish polish, while a back surface 155 of the wafer is not polished to a finish polish. It is understood, however, that the back surface 155 of the wafer 35 can be polished to a finish polish by flipping the wafer over and polishing its back surface. Most wafers 35 additionally have a small chord of material, or a notch, removed from the edge of the wafer (not shown). The front surface 39 of the wafers 35 are uniform. The wafers may be used in lithographic imprinting of circuits among other uses.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A wafer polishing apparatus comprising:

a base;

a turntable having a polishing pad thereon and mounted on the base for rotation of the turntable and polishing pad relative to the base about an axis perpendicular to the turntable and polishing pad, the polishing pad including a work surface engageable with a front surface of a wafer for polishing the front surface of the wafer;

a drive mechanism mounted on the base for imparting rotational motion about an axis substantially parallel to the axis of the turntable; and a polishing head connected to the drive mechanism for driving rotation of the polishing head, the polishing head having a pressure plate adapted to hold the wafer for engaging the front surface of the wafer with the work surface of the polishing pad, the pressure plate comprising a support plate and an annular wall extending from the support plate, the support plate having a generally planar position and being selectively movable from the planar position to a convex position and to a concave position, wherein the support plate is deflectable at its center by about 50 micrometers, the annular wall has a thickness between 2 millimeters (0.079 inches) and about 3 millimeters (0.118 inches) and defining a hinge about which the support plate can deflect from the planar position to one of the convex and concave positions, the annular wall flexing outward in relation to the upwards deflection of the support plate to the concave position, the annular wall flexing inward in relation to the downwards deflection of the support plate to the convex position.

2. The wafer polishing apparatus as set forth in claim 1 further comprising a first pressure source for applying a positive pressure to the support plate to cause the support plate to move from the planar position to the convex position and for pulling a vacuum to cause the support plate to move from the planar position to the concave position.

3. The wafer polishing apparatus as set forth in claim 2 wherein the support plate and the annular wall defining at least in part a first interior chamber.

4. The wafer polishing apparatus as set forth in claim 3 further comprising a retaining plate, the retaining plate, support plate and the annular wall defining the first interior chamber.

5. The wafer polishing apparatus as set forth in claim 1 wherein the pressure plate includes a plurality of passages extending through the pressure plate.

6. The wafer polishing apparatus set forth in claim 5 further comprising a second pressure source for applying a pressure to the passages extending through the pressure plate.

7. The wafer polishing apparatus set forth in claim 6 further comprising a baffle plate mounted on the pressure plate, the baffle plate and pressure plate cooperatively defining a second interior chamber.

8. The wafer polishing apparatus as set forth in claim 1 wherein the pressure plate is made of stainless steel.

9. A method of polishing a semiconductor wafer comprising the steps of:

quantifying the flatness of a front surface of the semiconductor wafer;

placing the semiconductor wafer in contact with a polishing head of a wafer polishing apparatus, the polishing head having a pressure plate and a support plate, the wafer being placed in direct contact with the support plate, and an annular wall extending from the support plate;

positioning the wafer held by the polishing head so that a front surface of the wafer engages a work surface of the polishing pad;

urging the front surface of the wafer against the polishing pad;

deflecting the support plate from a generally planar position to one of a convex position and a concave position based on the flatness of the front surface of the wafer, wherein deflection of the support plate from one of the convex and concave positions flexes the annular wall, wherein the support plate is deflectable at its center by about 50 millimeters and the annular wall has a thickness between 2 millimeters (0.079 inches) and about 3 millimeters (0.118 inches) and;

driving rotation of a polishing pad on a turntable of the polishing apparatus about a first axis;

driving rotation of the polishing head generally about a second axis non-coincident with the first axis to thereby polish the front surface of the wafer;

disengaging the wafer from the turntable; and removing the wafer from the polishing head.

10. A method as set forth in claim 9 wherein the step of deflecting the support plate comprises deflecting the support plate from its generally planar position to its convex position for polishing a wafer having a generally dome shaped front surface.

11. A method as set forth in claim 10 further comprising pressurizing a first interior chamber of the polishing head for deflecting the support plate.

12. A method as set forth in claim 9 wherein the step of deflecting the support plate comprises deflecting the support plate from its generally planar position to its concave position for polishing a wafer having a generally dish shaped front surface.

13. A method as set forth in claim 12 further comprising applying a vacuum to a first interior chamber of the polishing head for deflecting the support plate.

14. A method as set forth in claim 9 wherein the step for placing the semiconductor wafer placed in direct contact with the support plate comprises applying a vacuum through support plate to a back surface of the wafer.

15. A method as set forth in claim 9 further comprising oscillating the front surface of the wafer with respect to the work surface of the polishing pad.

16. A method of polishing a batch of semiconductor wafer comprising the steps of:

placing one of the semiconductor wafers from the batch in contact with a polishing head of a wafer polishing apparatus, the polishing head having a pressure plate, a support plate and an annular wall extending from the support plate, the wafer being placed in direct contact with the support plate;

positioning the wafer held by the polishing head so that a front surface of the wafer engages a work surface of the polishing pad, the work surface having wear;

deflecting the support plate from a generally planar position to one of a convex position and a concave position based on the amount of wear in the work surface of the polishing pad, wherein deflection of the support plate from one of the convex and concave positions flexes the annular wall, wherein the support plate is deflectable at its center by about 50 millimeters and the annular wall has a thickness between 2 millimeters (0.079 inches) and about 3 millimeters (0.118 inches) and;

urging the front surface of the wafer against the polishing pad;

driving rotation of a polishing pad on a turntable of the polishing apparatus about a first axis;

driving rotation of the polishing head generally about a second axis non-coincident with the first axis to thereby polish the front surface of the wafer;

disengaging the wafer from the turntable; and removing the wafer from the polishing head.

17. A method as set forth in claim 16 further comprising quantifying the flatness of the front surface of the wafer.

* * * * *